US007383590B1

(12) United States Patent
Duncan

(10) Patent No.: US 7,383,590 B1
(45) Date of Patent: Jun. 10, 2008

(54) MULTIPURPOSE HAND GRIP

(76) Inventor: David Duncan, P.O. Box 802882, Santa Clarita, CA (US) 91380-2882

( * ) Notice: Subject to any disclaimer, the term of this patent is extended or adjusted under 35 U.S.C. 154(b) by 0 days.

(21) Appl. No.: 11/014,162

(22) Filed: Dec. 15, 2004

Related U.S. Application Data

(60) Provisional application No. 60/529,821, filed on Dec. 16, 2003.

(51) Int. Cl.
*A41D 19/01* (2006.01)

(52) U.S. Cl. ..... 2/158; 2/161.6

(58) Field of Classification Search ..... 2/16, 2/20, 161.6, 158
See application file for complete search history.

(56) References Cited

U.S. PATENT DOCUMENTS 1,673,517 A * 6/1928 Kurz ..... 2/161.8
2,040,137 A * 5/1936 Jensen ..... 2/20
2,128,796 A * 8/1938 Bohm-Myro ..... 2/158
2,357,574 A * 9/1944 Beebe ..... 2/161.6
2,571,228 A * 10/1951 Freeman et al. ..... 2/158
4,330,887 A * 5/1982 White ..... 2/16
4,645,251 A * 2/1987 Jacobs ..... 294/1.3
4,779,289 A * 10/1988 Prouty ..... 2/16
5,678,249 A * 10/1997 Smith ..... 2/161.5
5,711,032 A * 1/1998 Carpenter ..... 2/158
6,240,565 B1 * 6/2001 Spear ..... 2/158
6,298,488 B1 * 10/2001 Duncan et al. ..... 2/158
6,931,666 B1 * 8/2005 Brady ..... 2/161.6

* cited by examiner

*Primary Examiner*—Katherine Moran

(57) ABSTRACT

A hand grip and arm protection device composed of a water-resistant and stain-proof material, having temperature control characteristics and having a pair of sheets, with each sheet having a textured, recessed imprint on one surface providing a non-slip contact surface, while the opposite surface of the sheet, composed of a close fabricated fabric, is affixed to the sheet of textured, non-slip contact surface material. The fabric sheet of nylon/polyester composition is affixed to the non-slip contact surface sheet composed of a chloride rubber composition. The two-piece pair of sheets are sewn together by means of a zigzag lock stitch employing nylon thread. Both exterior surfaces include a cross-cut textured recessed imprint.

4 Claims, 4 Drawing Sheets

MULTIPURPOSE HAND GRIP

This application claims benefit of application Ser. No. 60/529,821 filed Dec. 16, 2003.

BACKGROUND OF THE INVENTION

1. Field of the Invention

The present invention relates to multipurpose kitchen implements for supporting, holding or gripping a variety of hot or cold articles, such as cooking pots, pans, lids, handles, or the like and for protecting the hand, wrist or arm during the handling of such hot or cold articles.

2. Brief Description of the Prior Art

In the past, it has been the conventional practice to employ cloth mitts and/or potholders for protecting the hands of the user from injury or burning when handling excessive hot or cold articles in the kitchen, such as cooking pots, pans, frozen products or the like. Also, fabric or other porous materials are currently being used for supporting heated articles in order to protect a table or counter surface. In some instances, temperature resistance materials are used in the form of gloves or non-contoured pads. Such conventional kitchen implements are disclosed in U.S. Pat. Nos. 2,261,064; 3,535,708; 4,071,921 and 6,298,488.

However, these prior kitchen implements cover only the hand and leave the wrist, arm and shoulder uncovered and subject to injury from an excessively hot or cold surrounding environment.

Further problems and difficulties have been encountered when using such conventional kitchen implements which stem largely from the fact that the hand grips are composed of cloth and are not water-repellant, stain resistant and lack temperature control. The prior kitchen implements permit liquids to penetrate straight through to the hand or fingers of the user when used as a mitt or potholder. Such penetration serves as a conductor for hot or frozen substances and transmits the excessive heat or cold directly to the user's hands. Furthermore, the liquid or substance stains the material and now must be treated and laundered. During the treatment and laundering procedure, the soiled mitt or potholder is out of service requiring the user to have backup implements. Even after laundering, conventional mitts, potholders and trivets remain permanently stained.

Additionally, prior hand grips do not provide extended ridges, lobes, or reinforcement pads that surround or encircle the article to be gripped. Gloves, mitts, and flat pads are examples. Also, a substantial exterior area of conventional grips or gloves are unused for carrying indicia for advertising or entertainment purposes. No visual effects are carried on conventional mitts or gloves.

SUMMARY OF THE INVENTION

Accordingly, the above problems and difficulties are avoided by the present invention which provides a novel kitchen hand grip and arm protection device or implement which is composed of a water-resistant and stain-proof material, having temperature control or resistant characteristics. Such a material forms the implement from a pair of sheets, with each sheet having a textured, recessed imprint on one surface providing a non-slip contact surface, while the opposite surface of the sheet is composed of a close fabricated fabric which is affixed to the sheet of textured, non-slip contact surface material. The fabric sheet may be of nylon/polyester composition which is affixed to the non-slip contact surface sheet that may be composed of a chloride rubber composition. The two-piece, pair of sheets, require that the pair or two pieces of fabric and chloride rubber sheets be sewn together by means of a zigzag lock stitch employing nylon thread. Therefore, both exterior surfaces of the hand grip include a cross-cut textured recessed imprint providing a non-slip or gripping contact surface. The gripping pair of sheets serve as a very efficient hot or cold temperature insulator for the user's hands and fingers and the surface of the chloride rubber neoprene sheet resists impregnation by stains and other damaging compositions and such surface is easily washed when rinsed under water. Also, it is noted that the sheet of nylon/polyester fabric is water and stain resistant as well, which characteristics are greatly augmented when attached or carried on the sheet of chloride rubber neoprene. Reinforcement sections are applied to critical locations, such as the joining area of the thumb with the palm portion of the grip. Also, the length of the grip extends beyond the elbow to protect the upper arm and/or the shoulder.

Therefore, it is among the primary objects of the present invention to provide a novel kitchen implement which may take the form of a hand grip that has a composition characterized as being water-repellant, stain resistant and which includes temperature resistant characteristics for the protection of the user.

Another object of the present invention is to provide such kitchen implements which are intended to work with cast iron, aluminum, stainless steel or plastic microwave cookware and that is intended to be used with hot articles or articles subject to sub-zero or refrigerator freezer temperatures.

Still a further object of the present invention is to provide a multipurpose kitchen implement which is composed of a pair of sheets of flexible material which may be die-cut to the shape of a desired implement resulting in a two-piece hand grip that is water-resistant and protects not only the hands and fingers of the user from hot and cold liquids but also the upper arm and shoulder body areas.

Still a further object of the present invention is to provide a novel multipurpose kitchen implement that includes material which is water-repellent and stain proof and which further provides excessive temperature protection for the user and that provides a positive gripping contact, allowing the user to securely grasp either hot or frozen articles without fear of the article slipping from their hand.

A further object resides in providing a potholder, hot pad, or other kitchen hand grip which includes a surface having a high coefficient of friction, and that provides exterior surface areas for applying decorative or graphic representations for pictorial or entertainment purposes.

An object resides in providing reinforcement sections at critical areas of wear on a grip while maintaining flexibility and hand protection.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figure 1:
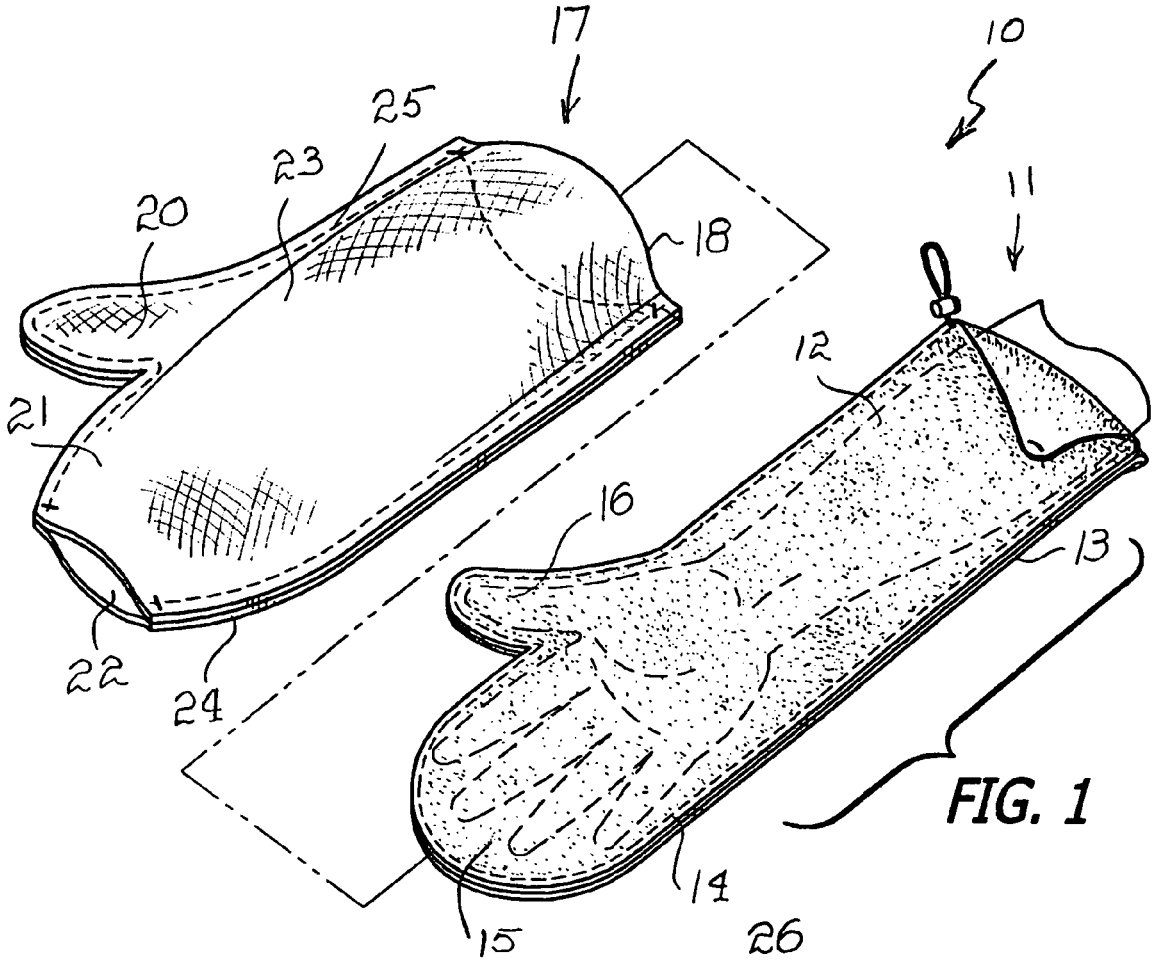
FIG. 1 is a front perspective view illustrating an extended hand grip and an outer sleeve combination incorporating the present invention.

Referring to FIG. 1, an example of a novel kitchen implement, grip or aid, is illustrated in the general direction of arrow 10 which takes the form of an extended hand, wrist and arm covering intended to be worn when handling extremely hot or cold articles. The implement 10 includes a mitt 11, having a top sheet 12 and an under or opposite sheet 13, wherein the sheet 12 includes an irregular exterior surface and is intended to cover not only the user's hand and wrist, but a substantial portion of the lower arm as well. The top and bottom sheets 12 and 13 are each composed of a sheet or layer of nylon/polyester fabric and a layer of a chloride rubber "neoprene" composition. The layers are suitably affixed to one another such as by a stitching arrangement, indicated by numeral 14. When the sheets are die cut to a particular shape, such as that of a hand mitt, the two die cut sections comprising a top and bottom section or sheet have their peripheral edges together such as by the zig-zag stitch 14, representing a lock stitch. The zig-zag sewing compresses the peripheral edge marginal regions of the respective sheets so as to make a water-resistant seam to protect the hands of the wearer from hot or cold liquids. The pattern of the sheets include a mitt portion for receiving four fingers of the user's hands as identified by numeral 15, while a thumb portion 16 is provided for insertably receiving the thumb of the user. In order to doubly protect the hands of the user, the user's hand may be put into the mitt 11 followed by inserting the covered hand into a sleeve, indicated by numeral 17, that has an open entrance 18 for insertably receiving the finger portion and thumb portion of the covered hand. As the hand slips further into the internal area of the sleeve 17, the thumb portion 16 of the mitt will project into a thumb portion 20 of the sleeve 17 while the finger portion 15 of the mitt 11 fits into a finger portion 21 of the sleeve 17. It is to be noted that the extreme end of the sleeve portion 21 is open, as indicated by numeral 22, so that the finger portion 15 of the mitt will be exposed. This provides a better "feel" for the user, while the hand, wrist and lower arm are completely double-covered by both the material of the mitt and the material of the sleeve. It is noted that the sleeve is constructed in a similar manner to that previously described with respect to the mitt in that a pair of sheets, such as upper sheet 23 and lower sheet 24, are stitched together along their edge marginal regions as indicated by numeral 25.

Figure 2:
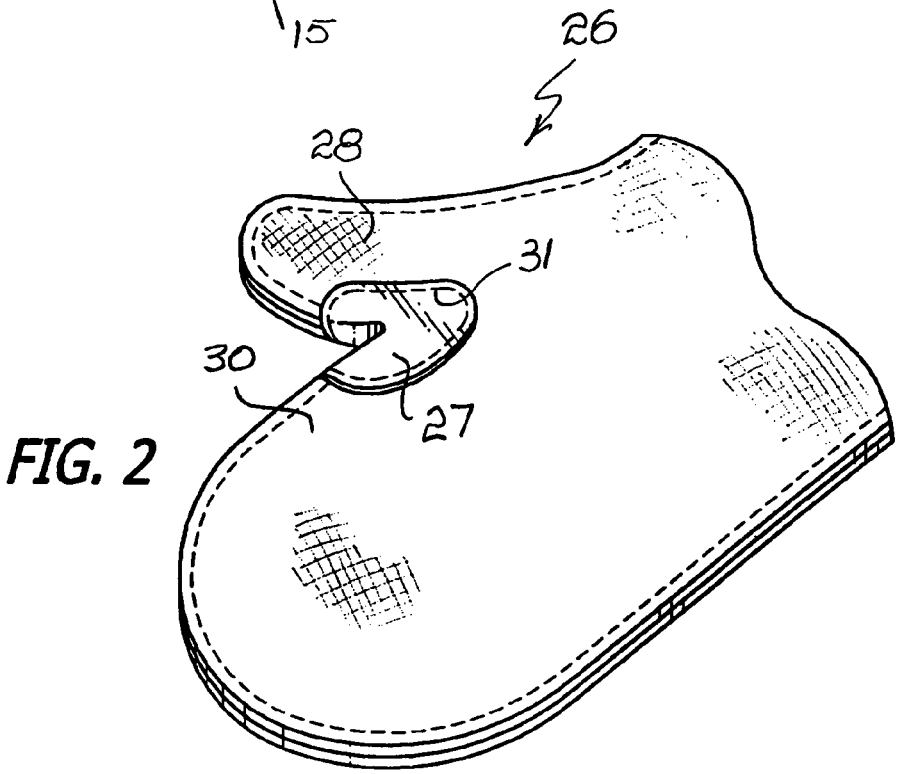
FIG. 2 is a front perspective view illustrating another version of the invention employing reinforcement at a critical location on a hand grip.

Referring now in detail to FIG. 2, the hand portion of an elongated mitt is illustrated in which the mitt 26 includes a reinforcing portion 27 that may be composed of any suitable material, such as metal, leather, metal mesh or the like. It is noted that a critical area of wear is between a thumb portion 28 and the palm or mitt finger portion 30. The reinforcement patch or portion is sewn to the mitt 26 by means of stitches 31 that secure the reinforcement to the mitt.

Figure 3:
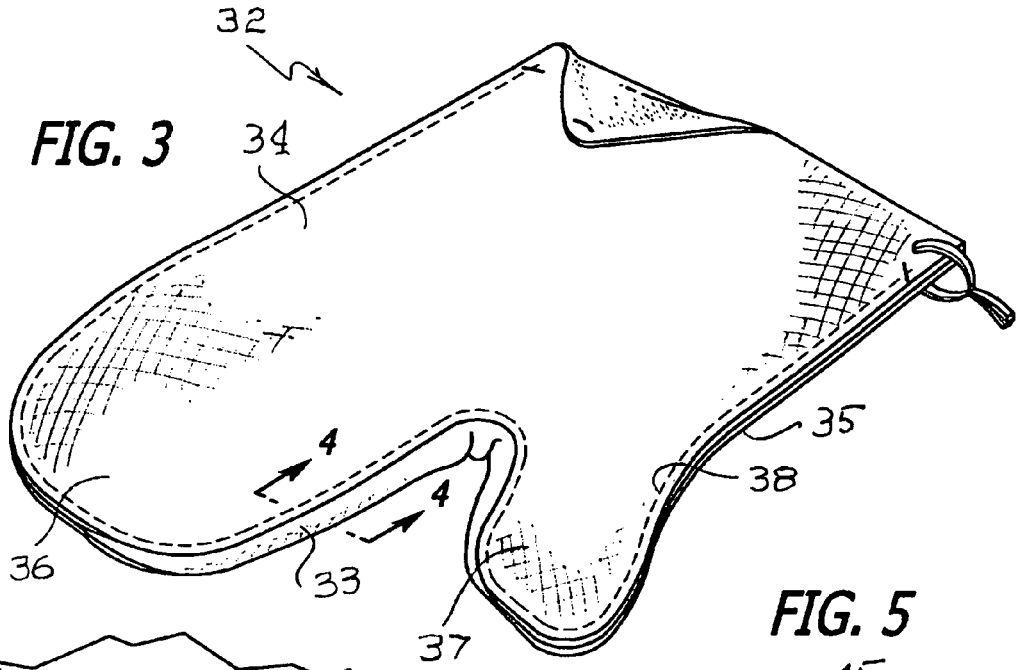
FIG. 3 is another version of a reinforced hand grip.

Referring now in detail to FIG. 3, another embodiment of the hand grip incorporating the present invention is illustrated in the direction of arrow 32 which includes a gusset 33 disposed between an upper sheet 34 and a lower or under sheet 35. The gusset 33 serves not only a reinforcement for a critical location on the mitt to prevent excessive wear, but is permitted to expand so as to permit substantial flexing or bending of the fingers while within the mitt. It can be seen that the gusset commences at one end of the finger portion 36 and continues to be between the finger portion and thumb portion where it terminates at the top of the thumb portion, which is indicated by numeral 37. The peripheral edge marginal regions of the layers 34 and 35 are stitched together, as previously described, and indicated by numeral 38.

Figure 4:
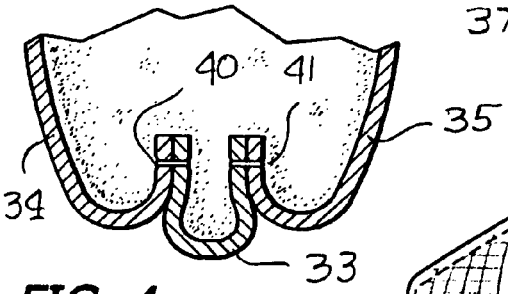
FIG. 4 is a fragmentary, sectional view of the reinforcement shown on the mitt of FIG. 3 as taken in the direction of arrows 4-4 thereof.

Referring to FIG. 4, it can be seen that the gusset 33 is secured to edge marginal portions of the upper and lower sheets or layers, represented by numerals 34 and 35 respectively. The stitching is indicated by numeral 40 for joining the edges of the gusset 33 and sheet 34, while numeral 41 indicates the stitching for joining the edges of sheet 35 with the gusset 33.

Figure 5:
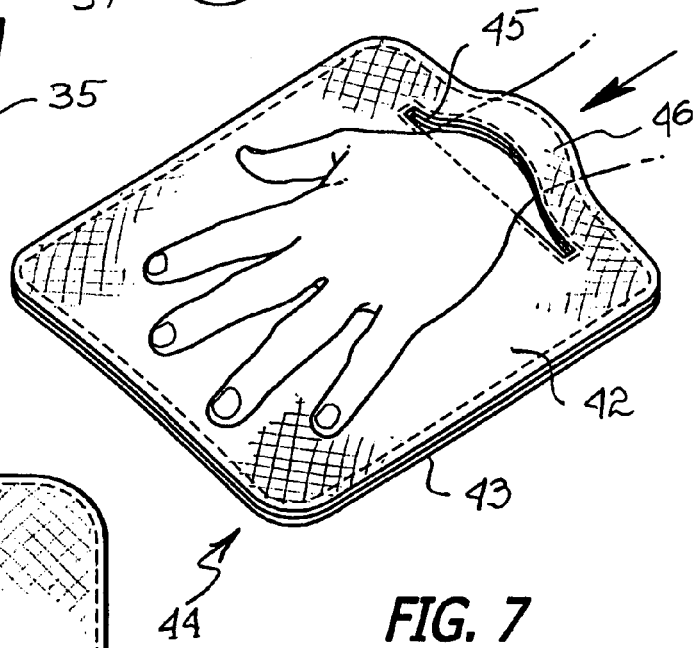
FIG. 5 is a different embodiment incorporating the present invention.
Figure 6:
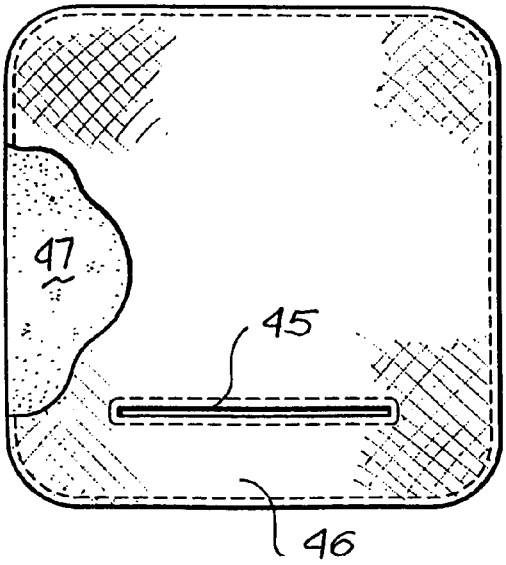
FIG. 6 is a bottom view of the hand mitt shown in FIG. 5.

Referring now in detail to FIGS. 5 and 6, another embodiment of the invention is illustrated taking the form of a hand grip mitt, wherein an upper layer is indicated by numeral 42 and the lower layer is indicated by numeral 43. The overall construction is illustrated in the direction of arrow 44 and it can be seen that the user's hand is inserted through a slot 45 under a wrist strap 46. The palm of the user's hand is placed against the waffled surface of the top sheet 42, while the exposed surface on sheet 43 is used for scouring or cleaning purposes. The numeral 47 indicates that the exposed undersurface of sheet 43 may have an abrasive surface 47.

Figure 7:
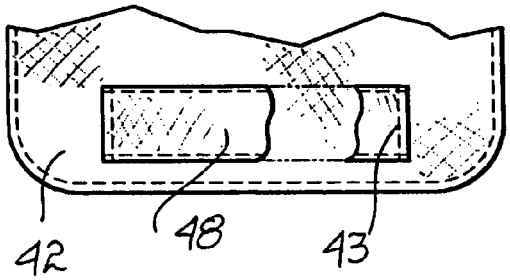
FIG. 7 is a fragmentary, top view illustrating another version for a wrist strap used as an alternate for the wrist strap shown on the grip or mitt in FIG. 5.

Referring to FIG. 7, another embodiment of the invention is illustrated wherein the mitt 44 includes a strap 48 which is stitched onto the upper or top sheet 42. The stitching is indicated by numeral 43 and it is to be understood that the user's hand would be inserted under the strap 48. In this instance, a slot 45 is not needed.

Figure 8:
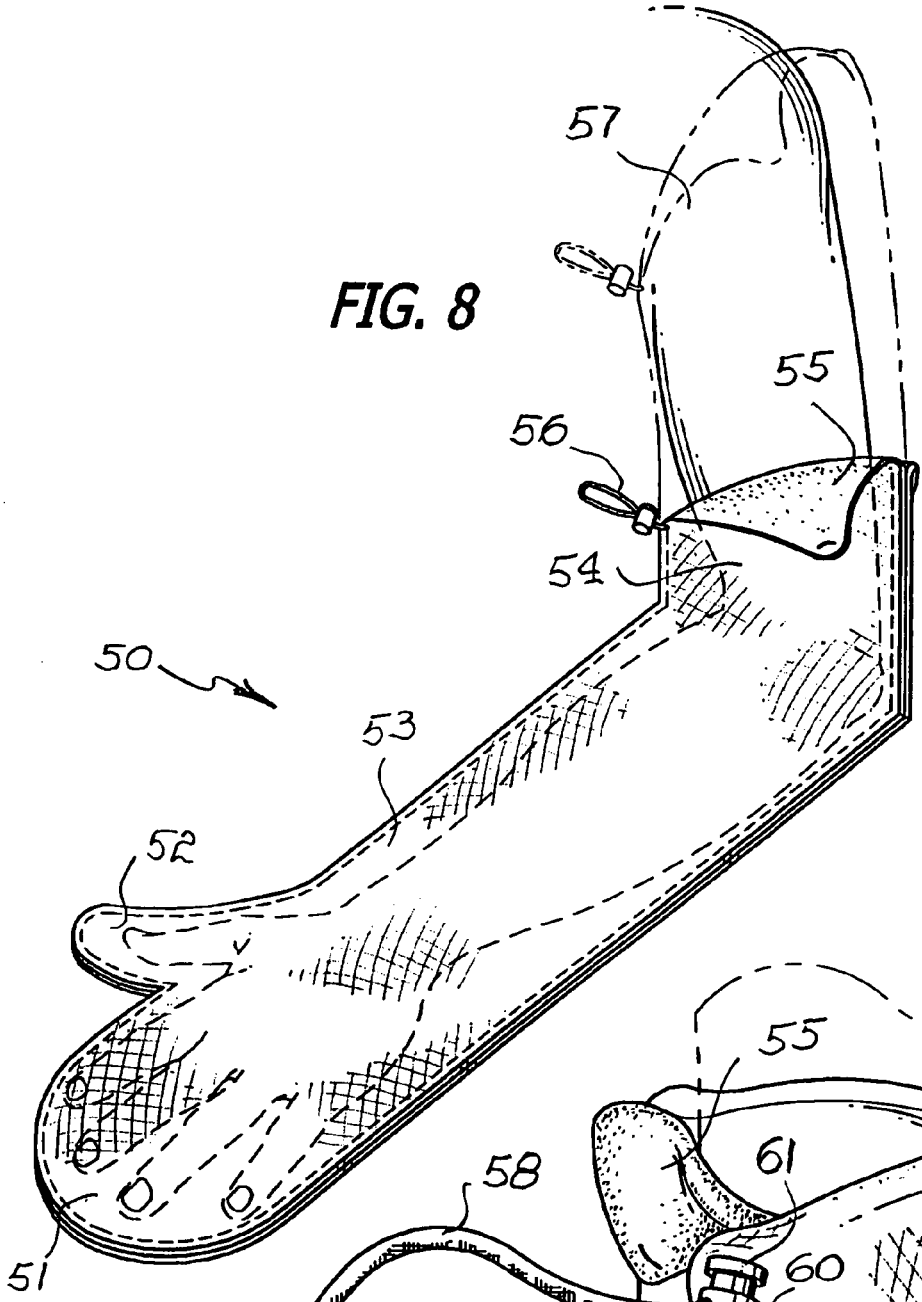
FIG. 8 is a perspective view of another elongated hand grip extending beyond the elbow of the user incorporating the present invention.
Figure 9:
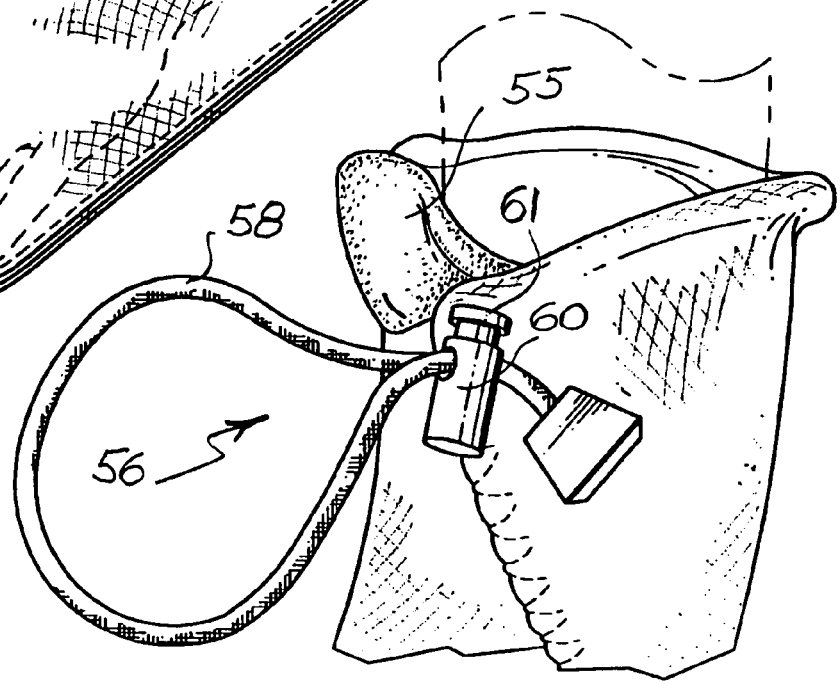
FIG. 9 is an enlarged, fragmentary perspective view illustrating the closure for the extended hand grip shown in FIG. 8.

Referring now in detail to FIG. 8, another embodiment of the invention is illustrated wherein the hand grip is elongated and is illustrated in the direction of arrow 50. The mitt 50 includes a finger portion 51 and a thumb portion 52 and an extended portion 53 which covers not only the hand but the wrist, lower arm and includes an extension 54 which goes beyond the elbow of the user. The top of the extension includes a flap 55 which may be employed to assist opening of the mitt so that the hand and arm can be extended therein. A closure fastener 56 is included and it can also be seen in broken lines that a portion 57 may extend to cover or partially cover the shoulder of the user. Such a mitt is extremely helpful. In FIG. 9, the fastener 56 includes a cord 58 that employs a cam lock 60 for selectively locking or unlocking the cord. When the cord has been pulled taunt the cuff or flap closure 55 will be held tight about the user's limb. For release, a push button 61 is employed to release tension on the cord to open the cuff permitting withdrawal of the user's arm.

Figure 10:
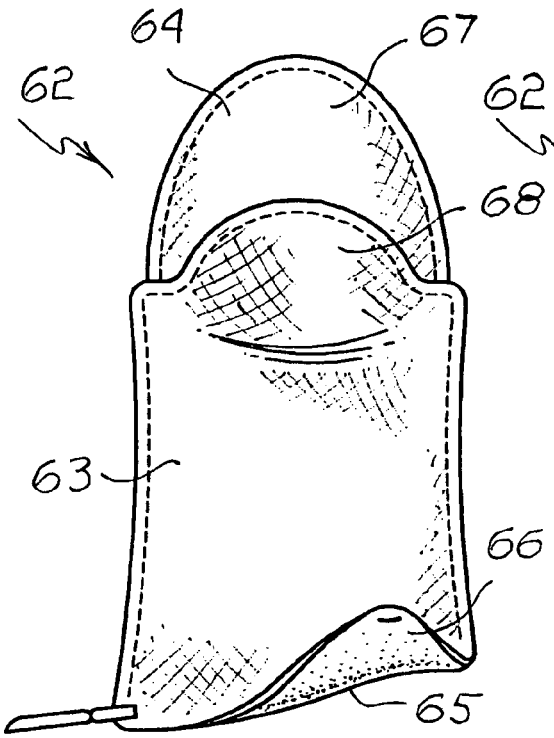
FIGS. 10 and 11 are front and rear or elevational views of another embodiment of the invention wherein areas on the hand grip are employed for carrying pictorial subject matter.
Figure 11:
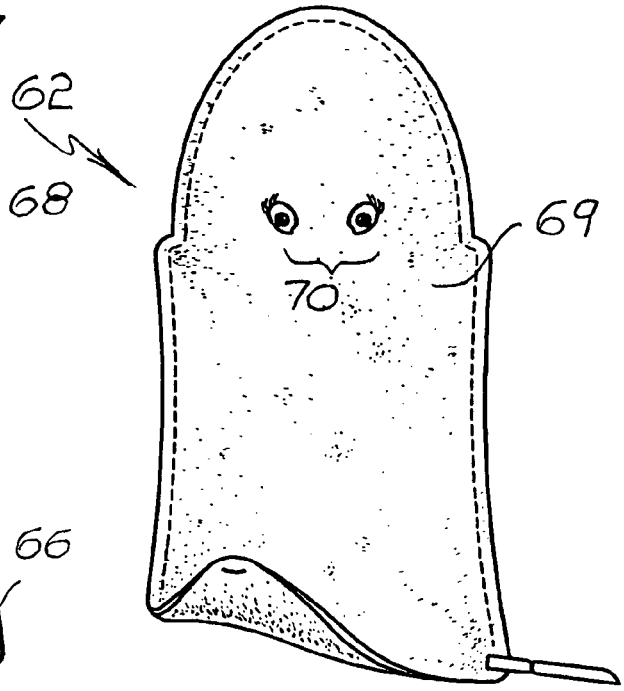

Referring to FIGS. 10 and 11, another version of the invention is illustrated which includes a mitt or hand grip as previously described and is illustrated in the general direction of arrow 62. The mitt 62 includes a bottom sheet 63 which is of shorter length than a top sheet 64. Therefore, a user's hand is introduced through an opening 65 with the assistance of flap 66 and the hand is inserted so that the fingers reside within a finger portion 67. The thumb of the user's hand will be inserted into a pocket 68. In FIG. 11, the top sheet 67 includes a back side 69 having a area thereon for carrying pictorial subject matter, such as "eyes", represented by numeral 70. Such graphic or pictorial subject matter may be placed on the front side, if desired. Therefore, when the user flexes the thumb and fingers, the eyes or whatever pictorial subject matter is portrayed, will appear to move. Such a construction provides an entertaining puppet-like mitt.

Figure 12:
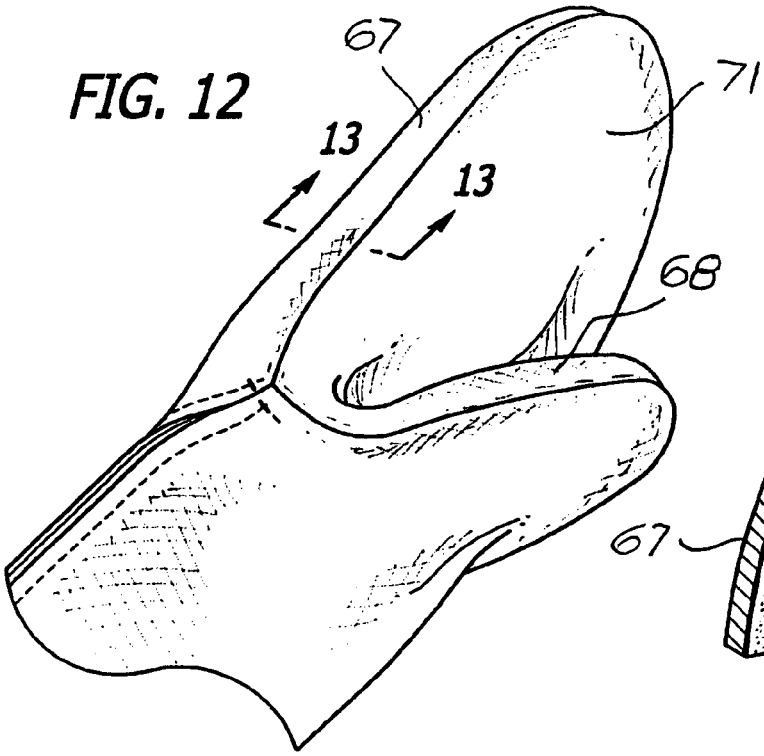
FIG. 12 is a perspective view illustrating the hand grip shown in FIGS. 10 and 11.
Figure 13:
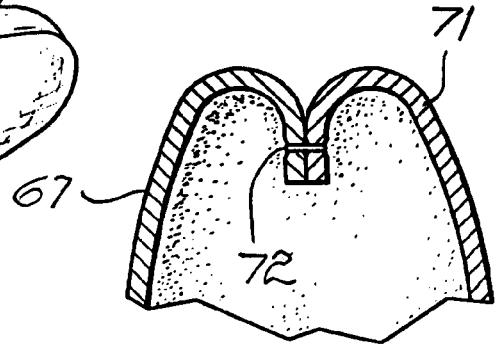
FIG. 13 is a transverse, cross-sectional view of the hand grip shown in FIG. 12 as taken in the direction of arrows 13-13 thereof.

In FIGS. 12 and 13, the finger portion 67 is illustrated as being formed of two sheets so as to provide an interior for receiving the fingers of the user's hand. The finger sheet also carries over to the inside of the thumb as represented by numeral 68. The inner sheet 71 is attached to the top sheet 67 by suitable stitching. Such stitching is shown internally by numeral 72 in FIG. 13.

Therefore, the pictorial or graphic subject matter may be placed on the outer sheet 69 or may be carried on the inner sheet 71 or even on the top sheet.

In view of the foregoing, it can be seen that the various embodiments of the present invention may be used to cover the hand, wrist, lower arm and even the upper arm and part of the shoulder. Also, a decorative or entertainment type mitt can be constructed wherein a puppet-like character is portrayed in graphic and pictorial subject matter on a selected sheet of the glove material. Also, various areas of wear may be reinforced by either a metal section or by employing gussets between the stitched edge portions of the respective mitt or grip sheets.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A hand and arm protection mitt comprising:

a pair of sheets formed in the shape of a mitt having a rounded finger portion, a thumb portion laterally projecting from said finger portion and a sleeve portion extending from said finger portion;

said mitt having a continuous peripheral edge marginal region at which said pair of sheets are affixed together;

a distal end of said sleeve portion providing an opening for insertably receiving the hand and arm of a user; and each sheet of said pair composed of a water-resistant and stain-proof material having temperature resistant characteristics, wherein the mitt further comprises means for reinforcing at least one of a palm portion and a part of the thumb portion and the finger portion of the mitt;

the protection mitt constitutes an inner protection mitt;

the means for reinforcing comprises an outer protection mitt having a conformal shape to said shape of said pair of sheets;

there is an open entrance in said outer protection mitt for insertably receiving and enclosing said inner protection mitt;

said outer protection mitt includes a finger portion having an opening at its opposite ends; and said finger portion and said sleeve portion are exposed via said open ends of said outer protection mitt.

2. The protection mitt defined in claim 1 wherein:

said distal end of said sleeve portion terminates with a flap folded over upon said distal end; and a draw-tightening device disposed on said distal end for releasably tightening said distal end about the arm of a user.

3. The protection mitt defined in claim 1 wherein:

the means for reinforcing comprises a reinforcement tab affixed to said pair of sheets at a junction of said thumb portion with said finger portion, wherein said tab is stitched to the pair of sheets.

4. A protection mitt for a hand of a user comprising:

a pair of sheets formed of a water-resistant and stain-proof material having temperature resistant characteristics;

said protection mitt having a continuous peripheral edge marginal region at which said pair of sheets are affixed together;

said protection mitt having a first protection mitt end and a second protection mitt end;

said second end of said protection mitt has an opening for insertably receiving the hand of the user;

the protection mitt comprises an inner protection mitt and a means outside the inner protection mitt for reinforcing the protection mitt;

the means outside the inner protection mitt for reinforcing comprises an outer protection mitt, which has a conformal shape to said shape of said pair of sheets;

there is an open entrance in said outer protection mitt for insertably receiving and enclosing said inner protection mitt; and said outer protection mitt includes openings at its opposite ends; and at least one portion of said inner protection mitt is exposed via said openings of the opposite ends of the outer protection mitt.

* * * * *